US008670687B2

(12) United States Patent
Namba

(10) Patent No.: US 8,670,687 B2
(45) Date of Patent: Mar. 11, 2014

(54) IMAGE FORMING MEMBER WITH CURRENT FLOWING TO TRANSFER BELT

(75) Inventor: Haruyuki Namba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 360 days.

(21) Appl. No.: 13/214,652

(22) Filed: Aug. 22, 2011

(65) Prior Publication Data

US 2012/0224882 A1 Sep. 6, 2012

(30) Foreign Application Priority Data

Mar. 1, 2011 (JP) ..... 2011-044017

(51) Int. Cl.
*G03G 15/16* (2006.01)

(52) U.S. Cl.
USPC ..... 399/101; 399/313; 399/314

(58) Field of Classification Search
USPC ..... 399/101, 302, 310, 312–314
See application file for complete search history.

(56) References Cited

U.S. PATENT DOCUMENTS 7,965,959 B2 * 6/2011 Ishikawa ..... 399/313
8,358,955 B2 * 1/2013 Echigo et al. ..... 399/314

FOREIGN PATENT DOCUMENTS

JP A-10-063108 3/1998
JP A-10-228158 8/1998
JP A-2004-101675 4/2004

* cited by examiner

*Primary Examiner* — William J Royer
(74) *Attorney, Agent, or Firm* — Oliff PLC

(57) ABSTRACT

An image forming apparatus includes an image carrier that carries a toner image; a transfer member that transfers the toner image to an object to be transferred at a transfer position that faces the image carrier; an endless transfer belt that is wound around the transfer member, and rotates circumferentially as the transfer member rotates; a facing member that is arranged to face the transfer member so as to nip the transfer belt at the transfer position; a transfer voltage application member that applies a voltage at the transfer position such that a transfer current flows between the transfer member and the facing member; and a conductive member to which a voltage is applied between the conductive member and a target member at a position different from the transfer position such that a current in a direction opposite to the transfer current flows to the transfer belt.

12 Claims, 8 Drawing Sheets

IMAGE FORMING MEMBER WITH CURRENT FLOWING TO TRANSFER BELT

CROSS-REFERENCE TO RELATED APPLICATIONS

This application is based on and claims priority under 35 USC 119 from Japanese Patent Application No. 2011-044017 filed Mar. 1, 2011.

BACKGROUND

Technical Field

The present invention relates to an image forming apparatus.

SUMMARY

According to an aspect of the invention, there is provided an image forming apparatus including an image carrier that carries a toner image; a transfer member that transfers the toner image carried on a surface of the image carrier to an object to be transferred at a transfer position that faces the image carrier; an endless transfer belt, having ion conductivity, that is wound around the transfer member, and rotates circumferentially while being nipped between the transfer member and the image carrier as the transfer member rotates; a facing member that is arranged to face the transfer member so as to nip the transfer belt at the transfer position; a transfer voltage application member that applies a voltage at the transfer position such that a transfer current flows between the transfer member and the facing member; and a conductive member to which a voltage is applied between the conductive member and a target member at a position different from the transfer position such that a current in a direction opposite to the transfer current flows to the transfer belt.

BRIEF DESCRIPTION OF THE DRAWINGS

Exemplary embodiments of the present invention will be described in detail based on the following figures, wherein.

DETAILED DESCRIPTION

An example of an image forming apparatus related to a first exemplary embodiment of the invention will be described with reference to FIGS. 1 to 4.

(Overall Configuration)

Figure 3:
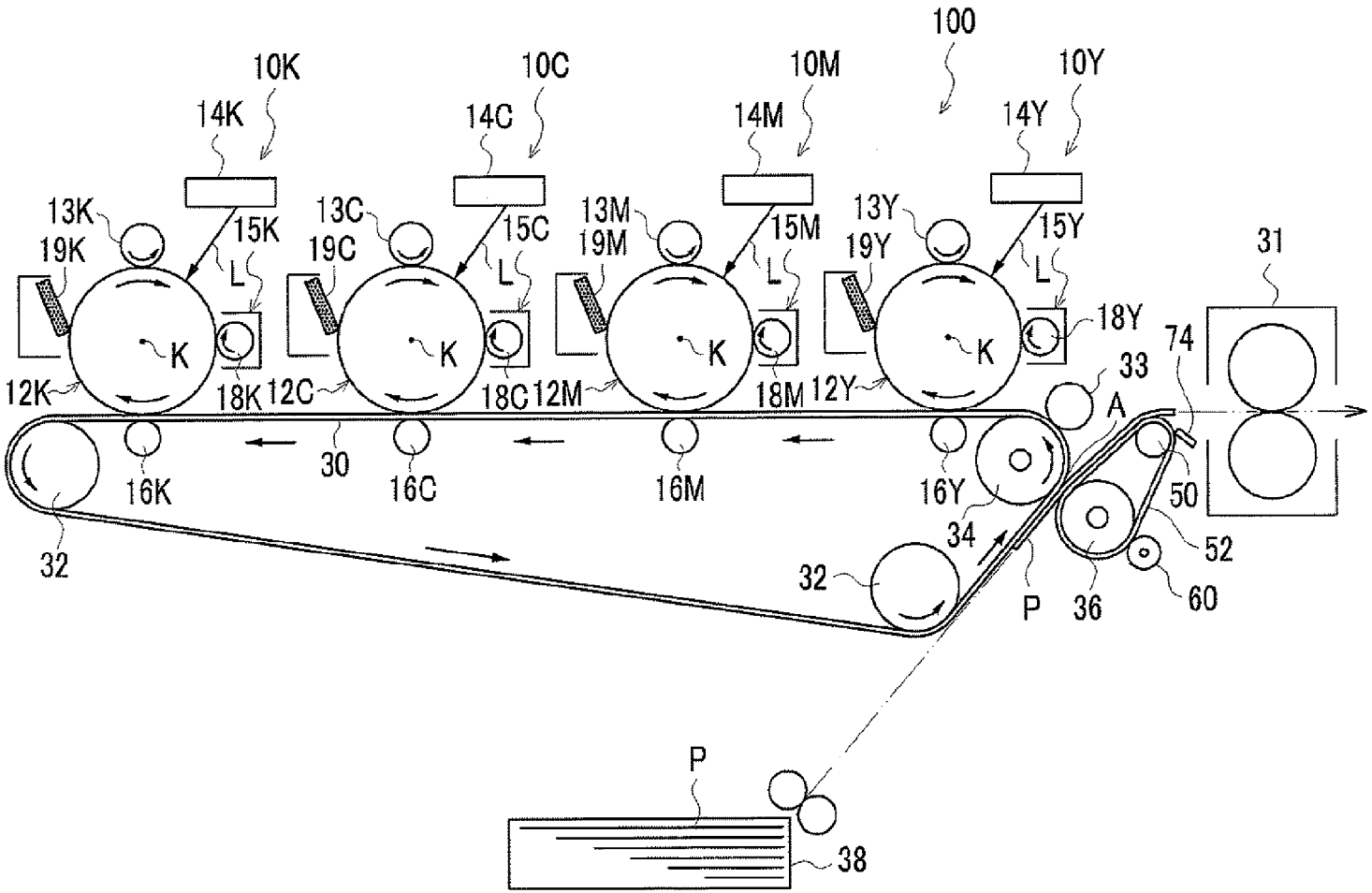
FIG. 3 is a schematic configuration diagram showing the image forming apparatus related to the first exemplary embodiment of the invention.

As shown in FIG. 3, an image forming apparatus 100 includes image forming units 10Y, 10M, 10C, and 10K that form toner images of respective colors of yellow (Y), magenta (M), cyan (C), and black (K). In addition, description will be made below with any of Y, M, C, and K given to the end of a symbol when YMCK needs to be distinguished from one another, and Y, M, C, and K will be omitted when YMCK do not need to be distinguished from one another.

The image forming units 10Y, 10M, 10C, and 10K are arranged in series in order of the image forming units 10Y, 10M, 10C, and 10K in the traveling direction of an intermediate transfer belt 30 (first transfer belt) as an example of an endless image carrier that rotates circumferentially (rotates) while being wound around a back-up roller 34 (target member) as an example of a facing member, and plural tension rollers 32.

Primary transfer rollers 16Y, 16M, 16C, and 16K, which transfer respective color toner images formed on the surfaces of photoreceptors 12 to the intermediate transfer belt 30, are provided opposite the photoreceptors 12Y, 12M, 12C, and 12K provided in the image forming units 10Y, 10M, 10C, and 10K, respectively, across the intermediate transfer belt 30. Specifically, transfer bias voltages are applied to the primary transfer rollers 16Y, 16M, 16C, and 16K, and respective color toner images are primarily transferred to the intermediate transfer belt 30 sequentially by electrostatic attractive forces.

Next, an image forming unit 10Y, which forms a yellow toner image as a representative of the configuration of the respective image forming units 10Y, 10M, 100, and 10K, will be described. In addition, the respective image forming units 10 have the same configuration.

A charging roller 13Y, which uniformly charges the surface of the photoreceptor 12Y in contact with the surface of the photoreceptor 12Y and rotates to follow the rotation of the photoreceptor 12Y, is provided opposite the photoreceptor 12Y across the intermediate transfer belt 30.

Moreover, an exposure device 14Y is provided to expose the surface of the charged photoreceptor 12Y formed by the charging roller 13Y with exposure light L and form an electrostatic latent image corresponding to a yellow image.

Additionally, a developing device 15Y, which makes the electrostatic latent image formed by the exposure device 14Y visible (developed) as a yellow toner image, is provided on the downstream side of the charging roller 13Y in the rotational direction of the photoreceptor 12Y. In detail, the developing device 15Y is provided with a developing roller 18Y that rotates to follow the rotation of the photoreceptor 12Y. Also, a toner charged with a negative voltage transfers to the electrostatic latent image formed on the surface of the photoreceptor 12Y from the outer peripheral surface of the developing roller 18Y so as to visualize (develop) the electrostatic latent image as a yellow toner image.

As mentioned above, toner images formed on the surfaces of the photoreceptors 12 for respective colors are sequentially transferred to the intermediate transfer belt 30 by the respective primary transfer rollers 16.

Moreover, a blade 19Y, which scrapes off the residual toner, which remains without being transferred to the intermediate transfer belt 30 from the surface of the photoreceptor 12Y, from the surface of the photoreceptor 12Y, is provided on the upstream side of the charging roller 13Y in the rotational direction of the photoreceptor 12Y.

On the other hand, a secondary transfer roller 36 as an example of a transfer member is rotatably provided opposite the back-up roller 34 across the intermediate transfer belt 30. Moreover, a secondary transfer belt 52 as an example of an endless transfer belt is wound around the secondary transfer roller 36 and a driven roller 50 arranged next to the secondary transfer roller 36. The secondary transfer roller 36 is adjusted to transfer the toner images formed on the intermediate transfer belt 30 to a sheet member P that is delivered from a sheet supply section 38 on which the sheet member P as a recording medium (object to be transferred) is stacked, and is nipped and conveyed between the intermediate transfer belt 30 and the secondary transfer belt 52. In addition, the secondary transfer roller 36, the secondary transfer belt 52, and the like including an application method of a transfer bias voltage or the like will be described below in detail.

Moreover, a fixing device 31, which fixes the toner images transferred to the sheet member P by heat and pressure onto the sheet member P, is provided on the downstream side of the secondary transfer roller 36 in the conveying direction of the sheet member P.

On the other hand, a cleaning roller 33, which cleans the residual toner that has not been transferred to the sheet member P from the intermediate transfer belt 30, is provided opposite the back-up roller 34 across the intermediate transfer belt 30.

When the image forming apparatus 100, as shown in FIG. 3, is operated according to the above configuration, the surfaces of the photoreceptors 12 for the respective colors are uniformly charged by the charging rollers 13. Next, the charged photoreceptor 12 is irradiated with exposure light L by the exposure device 14 for each color, and an electrostatic latent image corresponding to each color toner image is formed on the surface of the photoreceptor 12.

Moreover, each color toner to which a developing bias has been applied transfers to the electrostatic latent image formed on the surface of the photoreceptor 12 for each color from the outer peripheral surface of the developing roller 18, and an electrostatic latent image in each color is made visible (developed) as a toner image.

Additionally, the toner images formed on the surfaces of the photoreceptors 12 for the respective colors are primarily transferred onto the intermediate transfer belt 30 sequentially by the contact pressure of the primary transfer rollers 16, and the electrostatic attractive forces caused by the transfer bias voltages applied to the primary transfer rollers 16. That is, toner images in respective colors of Y, M, C, and K are sequentially superimposed on the intermediate transfer belt 30, thereby forming a multi-toner image (for example, color toner image).

Then, the multi-toner image formed on the intermediate transfer belt 30 is conveyed to a position that faces the secondary transfer belt 52 by the intermediate transfer belt 30 that rotates circumferentially. Moreover, the secondary transfer roller 36 transfers the toner images formed on the intermediate transfer belt 30 to a sheet member P that is delivered from the sheet supply section 38, and is nipped and conveyed between the intermediate transfer belt 30 and the secondary transfer belt 52.

The sheet member P to which the toner images have been transferred is conveyed toward the fixing device 31 along the secondary transfer belt 52. The toner images formed on the sheet member P conveyed to the fixing device 31 are fixed onto the sheet member P by heat and pressure, and the sheet member P is ejected to an ejection section (not shown).

(Configuration of Relevant Parts)

Next, the secondary transfer roller 36, the secondary transfer belt 52, an application method of a transfer bias voltage, and the like will be described.

Figure 1:
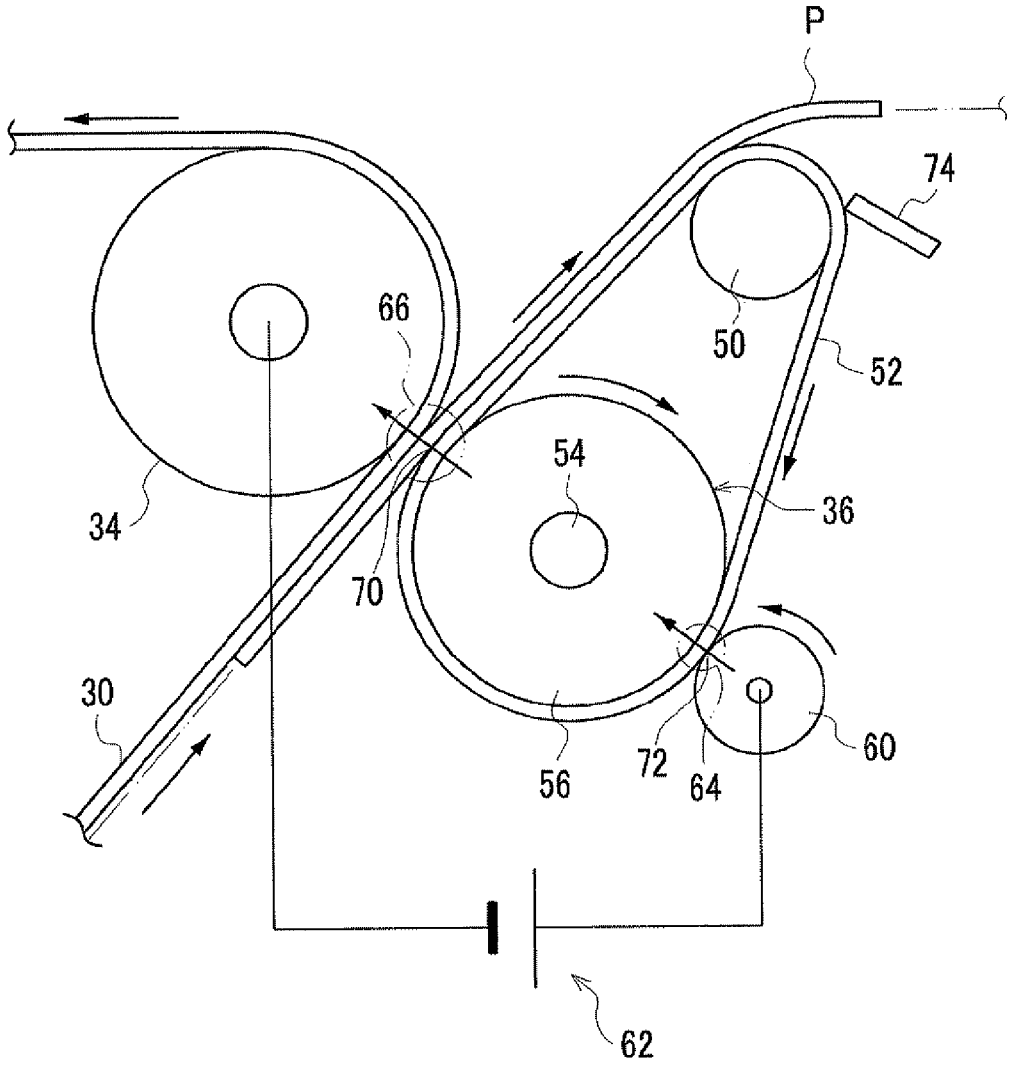
FIG. 1 is a configuration diagram showing a secondary transfer roller, a secondary transfer belt, and the like that are used for an image forming apparatus related to a first exemplary embodiment of the invention.

As shown in FIG. 1, the secondary transfer roller 36 that is rotated by a driving force from a motor (not shown) includes a columnar core 54 which has a diameter of 14 mm that becomes a rotary shaft, and an elastically deformable elastic layer 56 that is provided at the outer peripheral surface of the core 54. In detail, the elastic layer 56 is molded by adding carbon black (CB) to foamed EPDM rubber with a hardness of 35° (Aska hardness), thereby making the secondary transfer belt 52 electrically conductive. The resistance of the elastic layer 56 is set to 5.5 Log Ω. Additionally, the core 54 is brought into a state where neither a voltage is applied nor a voltage escapes, i.e., is electrically floated.

Additionally, the secondary transfer belt 52 wound around the secondary transfer roller 36 is formed with a thickness of 0.5 mm by blending NBR rubber and hydrin rubber, and includes an overcoat (OC) layer (not shown) with a thickness of about 0.005 mm on the surface thereof. The resistance of the secondary transfer belt 52 is set to 7.5 Log Ω·cm, the rubber layer of the secondary transfer belt 52 is made ion-conductive by containing quarternary ammonium salt, and the overcoat (OC) layer is made electrically conductive. That is, resistance unevenness occurring in the secondary transfer belt 52 is suppressed by using the secondary transfer belt 52 having ion conductivity.

Moreover, a conductive roller 60 as an example of a columnar conductive member that comes in contact with the surface of the secondary transfer belt 52 and is driven by the secondary transfer belt 52 is opposite the secondary transfer roller 36 across the secondary transfer belt 52.

Additionally, in order to transfer the toner images formed on the surface of the intermediate transfer belt 30 to a sheet member P, a power source 62 as an example of a transfer voltage application member that applies a voltage between the conductive roller 60 and the back-up roller 34 is provided such that a current (hereinafter referred to as a transfer current) for transferring the toner images to the sheet member P flows between the secondary transfer roller 36 and the back-up roller 34. In detail, as a voltage is applied by the power source 62, a current flows (refer to an arrow in the drawing) toward the secondary transfer roller 36 from the conductive roller 60 in a facing portion 64 where the conductive roller 60 and the secondary transfer roller 36 face each other, and a current flows (refer to an arrow in the drawing) toward the back-up roller 34 from the secondary transfer roller 36 in a facing portion 66 (transfer position) where the secondary transfer roller 36 and the back-up roller 34 face each other. That is, a current flows from the front surface of the secondary transfer belt 52 toward the rear surface thereof in the facing portion 64, and a current flows from the rear surface of the secondary transfer belt 52 toward the front surface thereof in the facing portion 66.

Additionally, a cleaning blade 74 as an example of a cleaning member, which cleans the secondary transfer belt 52 in contact with the surface of the secondary transfer belt 52, is provided opposite the driven roller 50 across the secondary transfer belt 52 on the downstream side of a first contact portion 70 between the secondary transfer belt 52 and the intermediate transfer belt 30, in the circumferential rotational direction of the secondary transfer belt 52, and on the upstream side of a second contact portion 72 between the secondary transfer belt 52 and the conductive roller 60 in the circumferential rotational direction of the secondary transfer belt 52.

(Action of Configuration of Relevant Parts)

Next, the action of transferring a toner image formed on the intermediate transfer belt 30 to a sheet member P will be described.

As shown in FIG. 1, first, a voltage is applied between the conductive roller 60 and the back-up roller 34 by the power source 62 such that the columnar core (core bar) 54 is electrically floated (in the present exemplary embodiment, a positive voltage is applied to the conductive roller 60 side).

Thereby, as indicated by arrows in the drawing, a current flows toward the secondary transfer roller 36 from the conductive roller 60 in the facing portion 64, and a current flows toward the back-up roller 34 from the secondary transfer roller 36 in the facing portion 66. That is, a current flows from the front surface of the secondary transfer belt 52 toward the rear surface thereof in the facing portion 64, and a current flows from the rear surface of the secondary transfer belt 52 toward the front surface thereof in the facing portion 66. This restrains ions of the secondary transfer belt 52 having ion conductivity from being polarized or unevenly distributed.

On the other hand, as a driving force is transmitted from a motor (not shown), the secondary transfer roller 36 rotates, and thereby, the secondary transfer belt 52 wound around the secondary transfer roller 36 also rotates circumferentially.

Moreover, a toner image formed on the intermediate transfer belt 30 and changed with a negative voltage is conveyed to a position that faces the secondary transfer belt 52 by the intermediate transfer belt 30 that rotates circumferentially. Then, the secondary transfer roller 36 transfers the toner images formed on the intermediate transfer belt 30 to a sheet member P that is delivered from the sheet supply section 38 (refer to FIG. 3), and is nipped and conveyed between the intermediate transfer belt 30 and the secondary transfer belt 52 (as a voltage is applied, a transfer current flows).

Here, the resistance maintainability of the secondary transfer belt 52 related to the first exemplary embodiment and the secondary transfer belt related to a comparative form over the first exemplary embodiment is evaluated.

When the first exemplary embodiment is evaluated, the secondary transfer belt 52 is wound around the secondary transfer roller 36 and the driven roller 50, and a metallic pipe having diameter of 50 mm as the back-up roller 34 is used opposite the secondary transfer roller 36 across the secondary transfer belt 52. Moreover, the secondary transfer belt 52 is circumferentially rotated for 90 hours (Hr) at a speed of 450 mm/s while a voltage at which the current between the conductive roller 60 and the back-up roller 34 becomes 100 μA (a constant current source is used) is applied, and the resistance of the secondary transfer belt 52 is measured.

Figure 4:
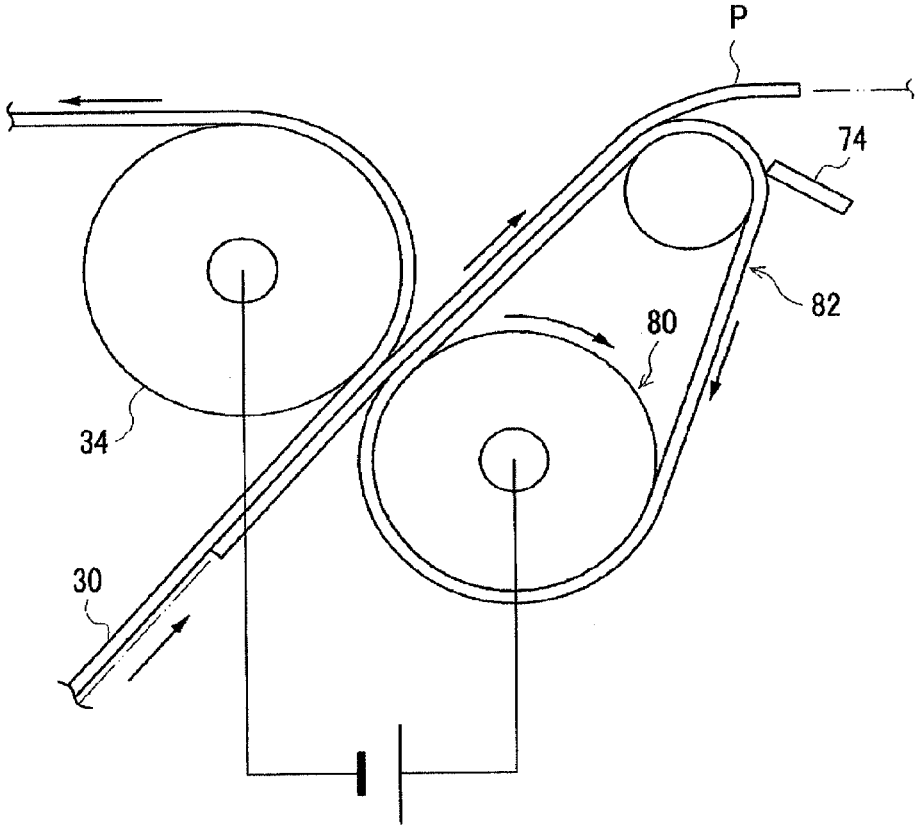
FIG. 4 RELATED ART
FIG. 4 is a configuration diagram showing a secondary transfer roller, a secondary transfer belt, and the like that are used for the image forming apparatus related to the comparative form for comparison with the image forming apparatus related to the first exemplary embodiment of the invention.

In contrast, when the comparative form is evaluated, as shown in FIG. 4, the conductive roller 60 is not used unlike the first exemplary embodiment, a secondary transfer belt 82 is circumferentially rotated for 90 hours (Hr) at a speed of 450 mm/s while a voltage at which the current between the secondary transfer roller 80 and the back-up roller 34 becomes 100 μA (a constant current source is used) is applied between a secondary transfer roller 80 and the back-up roller 34, and the resistance of the secondary transfer belt 82 is measured.

In addition, since toner is not used in the evaluation of both the first exemplary embodiment and the comparative form, evaluation is performed by removing the cleaning blade 74.

Figure 2:
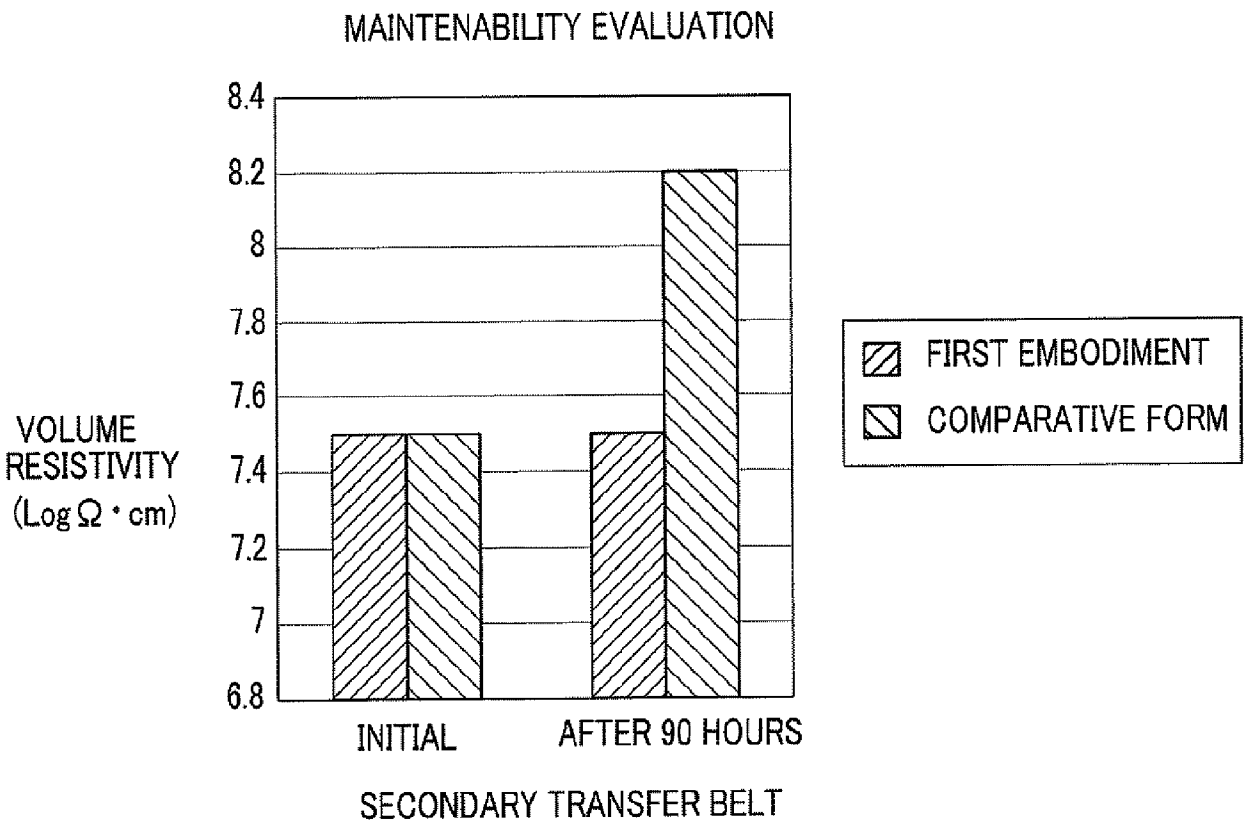
FIG. 2 is a bar graph showing evaluation results of the image forming apparatus related to the first exemplary embodiment of the invention and an image forming apparatus related to a comparative form.

The evaluation results of the first exemplary embodiment at the outset and after 90 hours and the evaluation results of the comparative form at the outset and after 90 hours are shown as a bar graph in which the vertical axis represents volume resistivity (Log Ω·cm) in FIG. 2.

As can be seen from these evaluation results, the volume resistivity (resistance) rises after 90 hours in the comparative form, whereas the volume resistivity (resistance) is constant (no change from the initial stage) even after 90 hours in the first exemplary embodiment. That is, it turns out that the resistance maintainability of the secondary transfer belt 52 of the first exemplary embodiment is improved as compared to the comparative form. In addition, the following is considered from these evaluation results.

The current from the core bar of the secondary transfer roller 80 used in the comparative form flows from the rear surface of the secondary transfer belt 82 toward the front surface thereof in a portion on which the back-up roller 34 contacts. If attention is paid to the secondary transfer belt 82, when a predetermined portion of the secondary transfer belt 82 rotates to the back-up roller 34, a current flows from the rear surface of the secondary transfer belt 82 toward the front surface thereof, and the direction thereof is always constant. Thereby, inside the secondary transfer belt 82 having ion conductivity, uneven distribution of ions and polarization of ions will occur and the resistance of the secondary transfer belt 82 will rise.

On the other hand, in the first exemplary embodiment, the current from the conductive roller 60 provided on the surface of the secondary transfer belt 52 flows from the front surface of the secondary transfer belt 52 to the rear surface thereof in the facing portion 64, and flows from the rear surface of the secondary transfer belt 52 to the front surface thereof in the facing portion 66. Currents in both the normal and reverse directions always act on the secondary transfer belt 52 that rotates circumferentially in this way in equal amounts. For this reason, uneven distribution of ions and polarization of ions do not occur, and a resistance change is believed to no longer be seen.

As described above, a rise in the resistance of the secondary transfer belt 52 having ion conductivity is suppressed with a simple configuration by providing the conductive roller 60 and the power source 62 to prevent uneven distribution of ions and polarization of ions.

Additionally, as a rise in the resistance of the secondary transfer belt 52 is suppressed, the transfer current is stabilized.

Additionally, as the transfer current is stabilized, poor transfer of a toner image to the sheet member P is suppressed.

Additionally, since the conductive roller 60 is made columnar and contacts on and rotates to follow the secondary transfer belt 52 that rotates circumferentially, the load of the secondary transfer belt 52 that occurs as the conductive roller 60 contacts on the secondary transfer belt 52 is reduced.

Additionally, the cleaning blade 74 that cleans the secondary transfer belt 52 is provided on the downstream side of the first contact portion 70 in the circumferential rotational direction of the secondary transfer belt 52, and on the upstream side of the second contact portion 72 in the circumferential rotational direction of the secondary transfer belt 52. This suppresses contamination of the conductive roller 60.

Additionally, since the configuration in which the conductive roller 60 is added over the related-art form (comparative form) is provided, enlargement of the image forming apparatus 100 is suppressed.

Additionally, since a current always flows to the back-up roller 34 from the secondary transfer roller 36 in the facing portion 66 (the transfer current flows in a fixed direction), decrease in productivity is also suppressed as compared to a configuration in which a current flows in an opposite direction at a transfer position.

Figure 5:
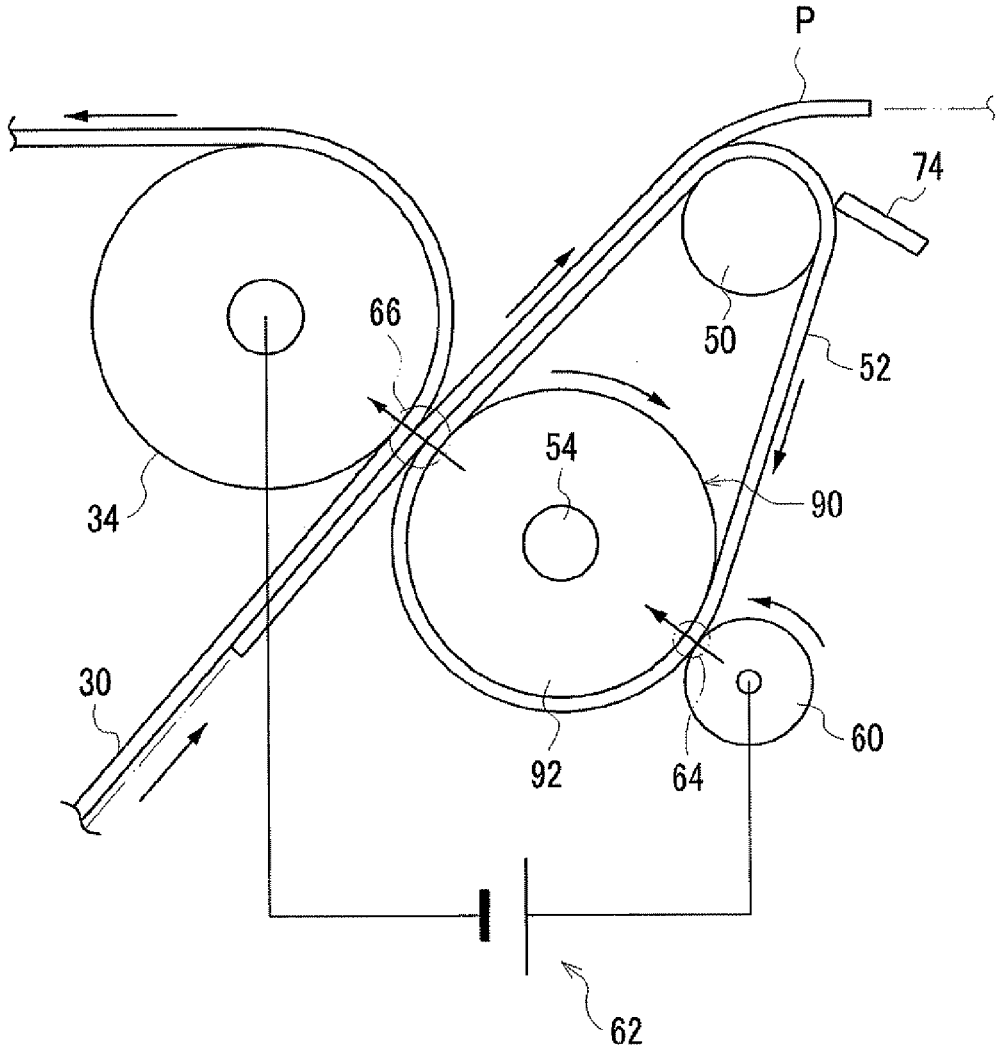
FIG. 5 is a configuration diagram showing a secondary transfer roller, a secondary transfer belt, and the like that are used for an image forming apparatus related to a second exemplary embodiment of the invention.

Next, an example of an image forming apparatus related to a second exemplary embodiment of the invention will be described with reference to FIGS. 5 and 6. In addition, the same members as those of the first exemplary embodiment will be designated by the same reference numerals, and the description thereof will be omitted.

In the second exemplary embodiment, a secondary transfer roller 90 has ion conductivity unlike the first exemplary embodiment. That is, resistance unevenness occurring in the secondary transfer roller 90 is suppressed as compared to electronic conductivity by using the secondary transfer roller 90 having ion conductivity.

Specifically, the secondary transfer roller 90 includes the columnar core 54 having a diameter of 14 mm that is used as a rotary shaft, and an elastically deformable elastic layer 92 that is provided at the outer peripheral surface of the core 54. In the elastic layer 92, the resistance is set to 7.3 Log Ω, and the hardness is set to 35° (Aska hardness) by making a urethane foamed material contain quarternary ammonium salt as an ion conductive agent.

Here, similarly to the first exemplary embodiment, the resistance maintainability of the secondary transfer belt 52 and the secondary transfer roller 90 related to the second exemplary embodiment, and the resistance maintainability of the secondary transfer belt and the secondary transfer roller related to a comparative form are evaluated.

When the second exemplary embodiment is evaluated, only the specification of the secondary transfer roller 90 is changed over an object used for evaluation of the first exemplary embodiment. The evaluation method is the same as that of the first exemplary embodiment.

In contrast, when the comparative form is evaluated, evaluation is made by using the object used for evaluation of the comparative form of the first exemplary embodiment.

The evaluation method of both the second exemplary embodiment and the comparative form is the same as the method described in the first exemplary embodiment. Additionally, as for evaluation items, the resistance of the secondary transfer belt and the resistance of the secondary transfer roller at the initial stage and after 90 hours are evaluated.

Figure 6:
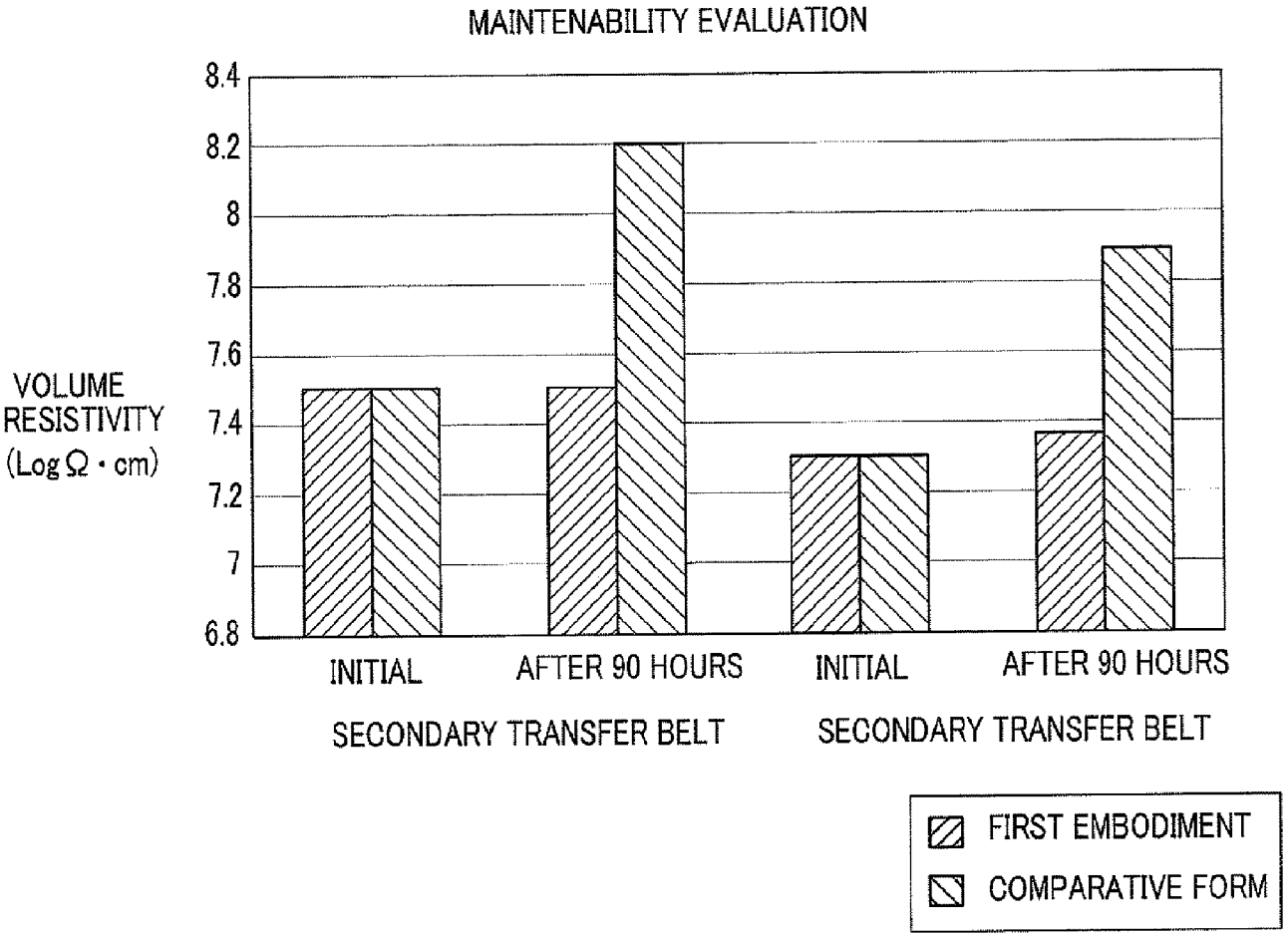
FIG. 6 is a bar graph showing evaluation results of the image forming apparatus related to the second exemplary embodiment of the invention and the image forming apparatus related to the comparative form.

The evaluation results of the second exemplary embodiment at the outset and after 90 hours and the evaluation results of the comparative format the outset and after 90 hours are shown as a bar graph in which the vertical axis represents volume resistivity (Log Ω·cm) in FIG. 6.

As can be seen from these evaluation results, it turns out that the resistance of the secondary transfer belt 52 and a rise in the volume resistivity (resistance) of the secondary transfer roller 90 after 90 hours of the second exemplary embodiment are suppressed compared to the comparative form for the same reason as the first exemplary embodiment.

Next, an example of an image forming apparatus related to a third exemplary embodiment of the invention will be described with reference to FIG. 7. In addition, the same members as those of the first exemplary embodiment will be designated by the same reference numerals, and the description thereof will be omitted.

Figure 7:
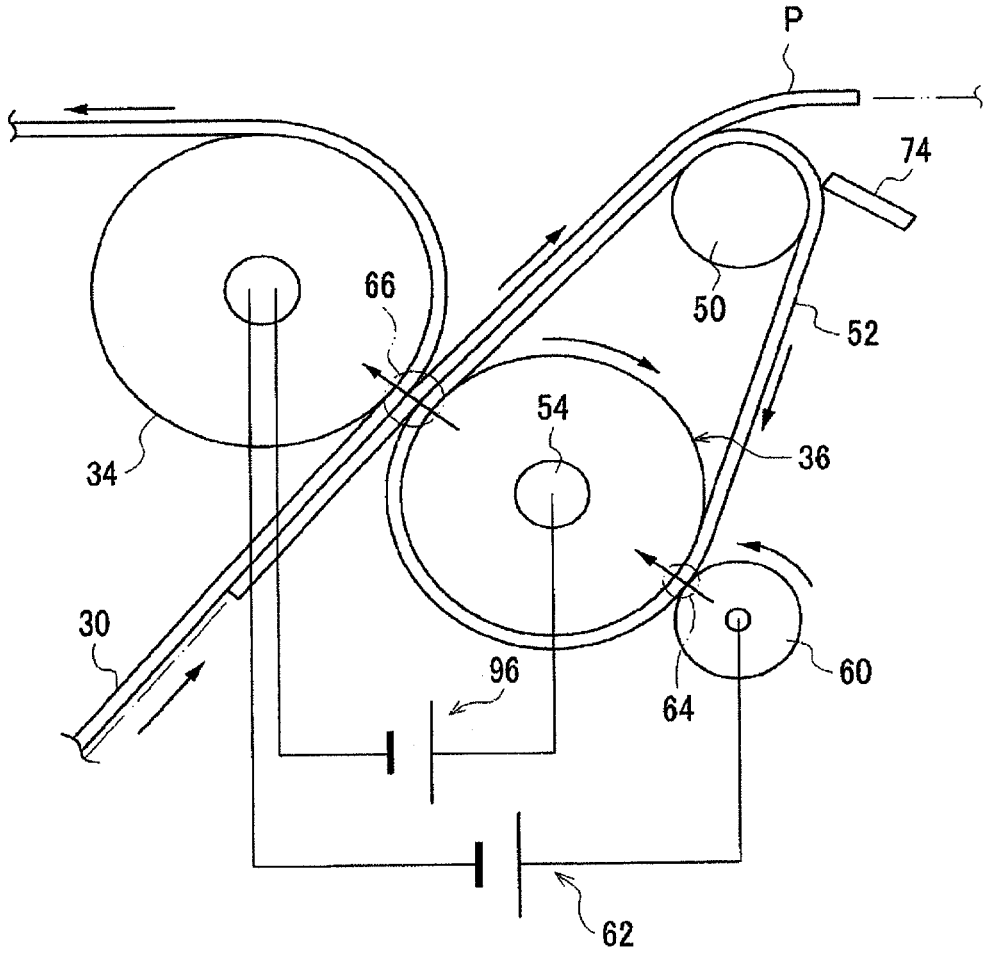
FIG. 7 is a configuration diagram showing a secondary transfer roller, a secondary transfer belt, and the like that are used for an image forming apparatus related to a third exemplary embodiment of the invention.

As shown in FIG. 7, in the third exemplary embodiment, in order to transfer the toner images formed on the surface of the intermediate transfer belt 30 to a sheet member P, a power source 96 as an example of a transfer voltage application member that applies a voltage between the core 54 of the secondary transfer roller 36 and the back-up roller 34 is provided such that the transfer current flows between the secondary transfer roller 36 and the back-up roller 34. As a result, the core 54 is not electrically floated.

According to the configuration described above, when the toner images formed on the surface of the intermediate transfer belt 30 are transferred to the sheet member P, a voltage is applied between the secondary transfer roller 36 and the back-up roller 34 by the power source 96, and the transfer current flows from the rear surface of the secondary transfer belt 52 toward the front surface thereof in the facing portion 66. For this reason, ions of the secondary transfer belt 52 having ion conductivity are polarized or unevenly distributed.

In a mode (cleaning mode) in which a rise in the resistance of the secondary transfer belt 52 is suppressed as ions of the secondary transfer belt 52 are polarized or unevenly distributed, a voltage is applied between the conductive roller 60 and the back-up roller 34 by the power source 62. Thereby, a current flows from the front surface of the secondary transfer belt 52 toward the rear surface thereof in the facing portion 64, and a rise in the resistance of the secondary transfer belt 52 is suppressed.

In addition, although the specific exemplary embodiments of the invention have been described in detail, the invention is not limited to these exemplary embodiments, and it is apparent to those skilled in the art that other various embodiments may be made within the scope of the invention. For example, in the above third exemplary embodiment, a current is passed from the front surface of the secondary transfer belt 52 toward the rear surface thereof by applying a voltage between the conductive roller 60 and the back-up roller 34 by the power source 62. However, a current may be passed from the front surface of the secondary transfer belt 52 toward the rear surface thereof by applying a voltage between the conductive roller 60 and the secondary transfer roller 36 by the power source 62.

Next, an example of an image forming apparatus related to a fourth exemplary embodiment of the invention will be described with reference to FIG. 8. In addition, the same members as those of the first exemplary embodiment will be designated by the same reference numerals, and the description thereof will be omitted.

Figure 8:
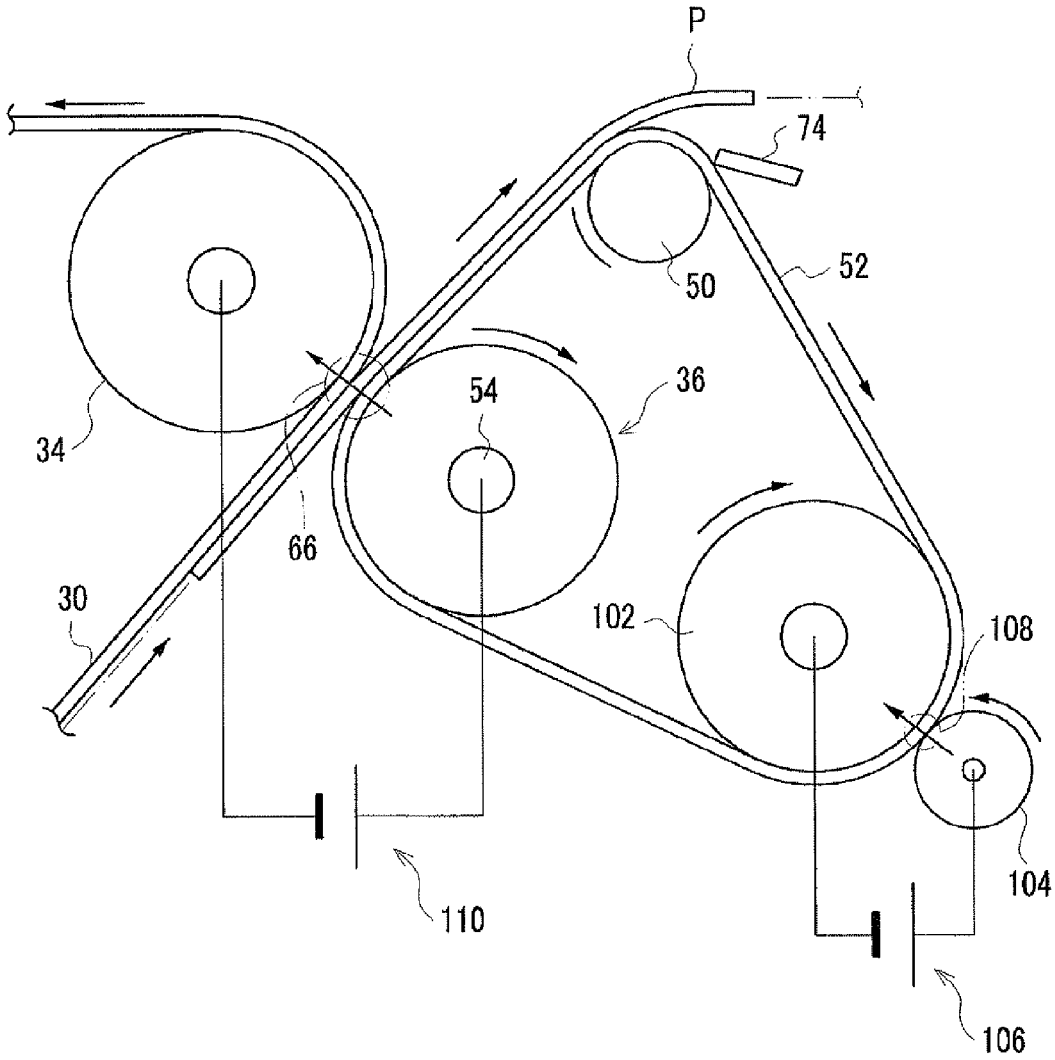
FIG. 8 is a configuration diagram showing a secondary transfer roller, a secondary transfer belt, and the like that are used for an image forming apparatus related to a fourth exemplary embodiment of the invention.

As shown in FIG. 8, in the fourth exemplary embodiment, in order to transfer the toner images formed on the surface of the intermediate transfer belt 30 to a sheet member P, a power source 110 as an example of a transfer voltage application member that applies a voltage between the core bar 54 of the secondary transfer roller 36 and the back-up roller 34 is provided such that the transfer current flows between the secondary transfer roller 36 and the back-up roller 34. As a result, the core bar 54 is not electrically floated.

Moreover, the secondary transfer belt 52 is wound around the secondary transfer roller 36, the driven roller 50, and a driven roller 102 formed from a material having conductivity. A conductive roller 104 as an example of a columnar conductive member that contacts on and rotates to follow the secondary transfer belt 52 is provided opposite the driven roller 102 across the secondary transfer belt 52.

Additionally, a power source 106 that applies a voltage is provided between the conductive roller 104 and the driven roller 102 such that a current flows toward the driven roller 102 from the conductive roller 104.

Due to the configuration described above, when the toner images formed on the surface of the intermediate transfer belt 30 are transferred to the sheet member P, a voltage is applied between the secondary transfer roller 36 and the back-up roller 34 by the power source 110, and the transfer current flows from the rear surface of the secondary transfer belt 52 toward the front surface thereof in the facing portion 66. For this reason, ions of the secondary transfer belt 52 having ion conductivity are polarized or unevenly distributed.

In a mode (cleaning mode) in which a rise in the resistance of the secondary transfer belt 52 is suppressed as ions of the secondary transfer belt 52 are polarized or unevenly distributed, a voltage is applied between the conductive roller 104 and the driven roller 102 by the power source 106. In a facing portion 108 where the conductive roller 104 and the driven roller 102 face each other, a current flows from the front surface of the secondary transfer belt 52 toward the rear surface thereof, and a rise in the resistance of the secondary transfer belt 52 is suppressed.

In addition, although the specific exemplary embodiments of the invention have been described in detail, the invention is not limited to these exemplary embodiments, and it is apparent to those skilled in the art that other various embodiments may be made within the scope of the invention. For example, although a rise in the resistance of the secondary transfer belt 52 is suppressed using the configuration of the invention for the secondary transfer belt 52 in the above first to fourth exemplary embodiments, the present embodiments may be used for the intermediate transfer belt (primary transfer belt) so as to suppress a rise in the resistance of the intermediate transfer belt. Additionally, the present embodiments may be used for a direct transfer belt for directly transferring a toner image formed on a photoreceptor to a sheet member P so as to suppress a rise in the resistance of a direct transfer belt.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries a toner image;

a transfer member that transfers the toner image carried on a surface of the image carrier to an object to be transferred at a transfer position that faces the image carrier;

an endless transfer belt, having ion conductivity, that is wound around the transfer member, and rotates circumferentially while being nipped between the transfer member and the image carrier as the transfer member rotates;

a facing member that is arranged to face the transfer member so as to nip the transfer belt at the transfer position;

a transfer voltage application member that applies a voltage at the transfer position such that a transfer current flows between the transfer member and the facing member; and a conductive member to which a voltage is applied between the conductive member and a target member at a position different from the transfer position such that a current in a direction opposite to the transfer current flows to the transfer belt.

2. The image forming apparatus according to claim 1, wherein the target member is the facing member, the conductive member is provided opposite the transfer member across the transfer belt, and a current flows via the transfer belt between the conductive member and the transfer member as a voltage is applied to either the conductive member or the facing member.

3. The image forming apparatus according to claim 2, wherein the transfer member has ion conductivity.

4. The image forming apparatus according to claim 2, wherein the conductive member is made columnar, and is driven by the transfer belt that rotates circumferentially.

5. The image forming apparatus according to claim 2, further comprising:

a cleaning member provided to clean the transfer belt in contact with a surface of the transfer belt, wherein the cleaning member is arranged on the downstream side of a first contact portion between the transfer belt and the image carrier in a circumferential rotational direction of the transfer belt, and on the upstream side of a second contact portion between the transfer belt and the conductive member in the circumferential rotational direction of the transfer belt.

6. The image forming apparatus according to claim 1, wherein the conductive member is made columnar, and rotates to follow the transfer belt that rotates circumferentially.

7. The image forming apparatus according to claim 1, further comprising:

a cleaning member provided to clean the transfer belt in contact with a surface of the transfer belt, wherein the cleaning member is arranged on the downstream side of a first contact portion between the transfer belt and the image carrier in a circumferential rotational direction of the transfer belt, and on the upstream side of a second contact portion between the transfer belt and the conductive member in the circumferential rotational direction of the transfer belt.

8. The image forming apparatus according to claim 1, wherein the transfer member contains an elastic layer on a core.

9. The image forming apparatus according to claim 8, wherein the core is electrically floated.

10. The image forming apparatus according to claim 9, wherein the core is not grounded.

11. The image forming apparatus according to claim 8, wherein the elastic layer contains foamed polyurethane.

12. The image forming apparatus according to claim 1, wherein a current flows from a front surface of the transfer belt toward a rear surface thereof in a facing portion between the conductive member and the transfer member, and a current flows from the rear surface of the transfer belt toward the front surface thereof in a facing portion between the transfer member and the facing member.

* * * * *